US010937269B2

(12) United States Patent
Roelofs et al.

(10) Patent No.: US 10,937,269 B2
(45) Date of Patent: Mar. 2, 2021

(54) ELECTRONIC GAMING MACHINES WITH FREE PLAY MULTIPLIERS

(71) Applicant: Aristocrat Technologies Australia Pty Limited, North Ryde (AU)

(72) Inventors: Karl A. Roelofs, Charlottesville, VA (US); David Marsh, Charlottesville, VA (US)

(73) Assignee: ARISTOCRAT TECHNOLOGIES AUSTRALIA PTY LIMITED, North Ryde (AU)

( * ) Notice: Subject to any disclaimer, the term of this patent is extended or adjusted under 35 U.S.C. 154(b) by 0 days.

(21) Appl. No.: 16/189,595

(22) Filed: Nov. 13, 2018

(65) Prior Publication Data

US 2020/0151998 A1 May 14, 2020

(51) Int. Cl.
*G07F 17/32* (2006.01)

(52) U.S. Cl.
CPC ..... *G07F 17/3213* (2013.01); *G07F 17/3244* (2013.01); *G07F 17/3267* (2013.01)

(58) Field of Classification Search
CPC ..... G07F 17/3262; G07F 17/3267; G07F 17/3213; G07F 17/3244
See application file for complete search history.

(56) References Cited

U.S. PATENT DOCUMENTS 9,564,002 B2 2/2017 Berman et al.
2003/0064772 A1 4/2003 Tempest et al.
2005/0119042 A1 6/2005 Chamberlain et al.
2005/0148382 A1 7/2005 Fox
2008/0113734 A1 5/2008 Watkins et al.
2010/0029381 A1* 2/2010 Vancura ..... G07F 17/3244 463/30
2012/0270638 A1 10/2012 Eubanks et al.
2014/0274277 A1 9/2014 Cuddy
2015/0221162 A1 8/2015 Peters et al.
2015/0294528 A1 10/2015 Young et al.

* cited by examiner

*Primary Examiner* — Omkar A Deodhar
*Assistant Examiner* — Ross A Williams
(74) *Attorney, Agent, or Firm* — McAndrews, Held & Malloy, Ltd.

(57) ABSTRACT

The present disclosure is directed towards Class II electronic gaming systems and/or machines that present a bingo game outcome (and/or associated bingo game reward) to a player via a spinning reel (and/or slot) game simulation. In some examples, the bingo game outcome may trigger a free spin feature mode comprised of one or more spinning reel game outcomes. During the free spin feature mode, each spinning reel game outcome may be a winning outcome, with an associated spinning reel game reward. The sum of the one or more spinning reel game rewards may be equal to the bingo game reward. In some examples, each spinning reel game reward may include a base reward and a multiplier. In some examples, the multiplier is always one (i.e., 1×) during regular play (i.e., not in free spin feature mode), and one or more (e.g., 1×, 2×, 3×, 4×, 5×, 10×, etc.) during free spin feature mode. The multiplier may be highlighted and/or emphasized when greater than one. The spinning reel game rewards may be presented in increasing order of the base reward.

16 Claims, 10 Drawing Sheets

ELECTRONIC GAMING MACHINES WITH FREE PLAY MULTIPLIERS

TECHNICAL FIELD

The present disclosure generally relates to electronic gaming machines, and, more particularly, to electronic gaming machines with free play award multipliers.

BACKGROUND

Electronic gaming systems and/or electronic gaming machines (EGMs) provide a variety of wagering games such as slot games, video poker games, video blackjack games, roulette games, video bingo games, keno games and other types of games that are frequently offered at casinos and other locations. Gameplay may involve a player establishing a credit balance by inputting money, or another form of monetary credit, and placing a monetary wager (from the credit balance) on one or more outcomes of an instance (or single play) of a primary game. Rewards from any winning outcomes may be added back to the credit balance, which may be provided to the player in a monetary or other form upon completion of a gaming session and/or when the player wants to "cash out."

Class II electronic gaming systems and/or EGMs present rewards and/or outcomes of a primary game to the player as rewards and/or outcomes of a secondary game. For example, a Class II EGM may operate a bingo or keno game as a primary game, and present the outcome of the bingo or keno game to a player via a slot game simulation. Class II games were developed as a response to certain government regulations that only allow certain games (e.g., bingo and/or keno games) in certain areas. As the simulation is not determinative of the game outcome, the Class II EGM complies with the government regulation. However, keeping the player continually engaged and/or excited by the simulation can be challenging.

SUMMARY

Systems and methods are provided for electronic gaming machines with free play multipliers, substantially as shown in and/or described in connection with at least one of the figures, as set forth more completely in the claims.

Various examples of the present disclosure are directed to Class II electronic gaming systems and/or electronic gaming machines. Some Class II electronic gaming systems and/or machines present a bingo game outcome (and/or associated bingo game reward) to a player via a spinning reel (and/or slot) game simulation. In some examples, the bingo game outcome (and/or bingo game reward) may trigger a special free spin (and/or free play) mode of the spinning reel game simulation. During free spin mode, one or more spinning reel game outcomes may be provided, with each spinning reel game outcome being a winning outcome with an associated spinning reel game reward. The sum of the one or more spinning reel game rewards may be equal to the bingo game reward.

Conventional Class II games sometimes provided multiple winning bingo game patterns, with each winning bingo pattern having its own bingo game outcome and/or reward. Free spin mode was originally developed to present each of these bingo game outcomes and/or rewards via their own single reel spin of the spinning reel game simulation, resulting in multiple "free spins." Free spin mode became popular, successfully increasing player engagement and/or excitement. However, some Class II games have now evolved to only reward the highest priority winning bingo game pattern. Thus, this disclosure contemplates presenting a free spin mode with one or more spinning reel game rewards that sum to a single reward associated with a single bingo game outcome and/or winning bingo game pattern.

In some examples, each spinning reel game reward may include a base reward and a multiplier. In some examples, the multiplier is always one (i.e., 1×) during regular play (i.e., not in free spin mode), and one or more (e.g., 1×, 2×, 3×, 4×, 5×, 10×, etc.) during free spin mode. The multiplier may be highlighted and/or emphasized when greater than one. The spinning reel game rewards may be presented in increasing order of the base reward.

The presentation of multiple winning outcomes and/or rewards during free spin mode may increase player engagement and/or player excitement. The presentation of multiple highlighted and/or emphasized multipliers during free spin mode may also increase player engagement and/or player excitement. Ordering the reward presentations according to base reward, instead of overall reward, during free spin mode may further increase player satisfaction, engagement and/or excitement.

Various advantages and features of the present disclosure will become apparent and more clearly understood in view of the detailed description, appended claims, and/or drawings of the present disclosure. In the following description, reference is made to drawings which show by way of illustration various disclosed examples that incorporate various examples of the present disclosure. These examples are described in sufficient detail to enable those skilled in the art to make or use the disclosed examples. Other examples may be utilized and other structural, logical, software, hardware, and electrical changes may be made without departing from the scope of the appended claims. The following description is, therefore, not to be taken in a limited sense.

DRAWING DESCRIPTIONS

Examples of the disclosure will now be described with reference to the accompanying drawings in which.

The figures are not necessarily to scale. Various dimensions may be exaggerated for illustrative clarity. Where appropriate, similar or identical reference numerals are used to refer to similar or identical components.

DESCRIPTION

Figure 1:
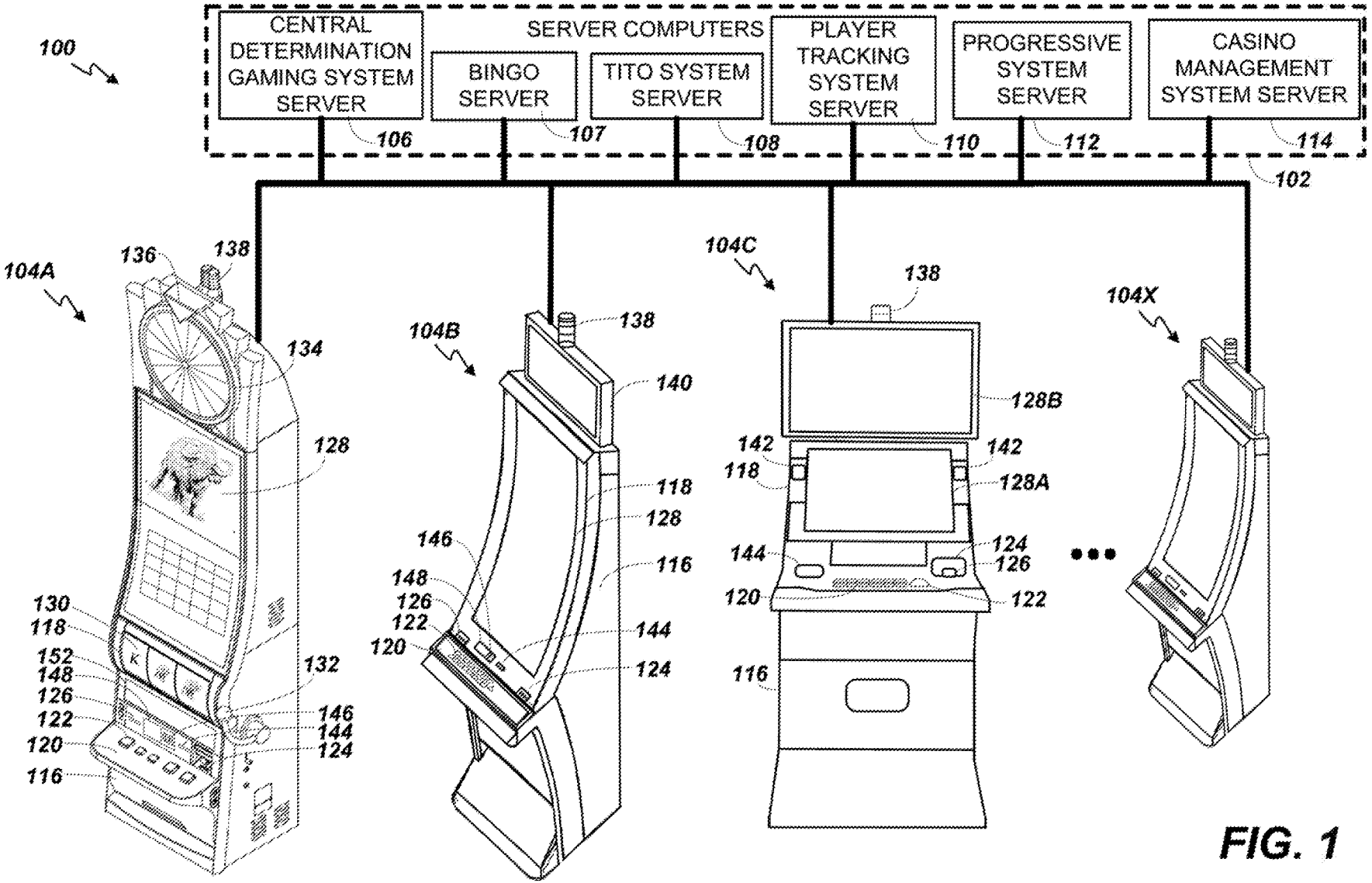
FIG. 1 is an example diagram showing several EGMs networked with various gaming related servers.

Preferred examples of the present disclosure may be described herein below with reference to the accompanying drawings. In the following description, well-known functions or constructions are not described in detail because they may obscure the disclosure in unnecessary detail. For this disclosure, the following terms and definitions shall apply.

As utilized herein, "and/or" means any one or more of the items in the list joined by "and/or". As an example, "x and/or y" means any element of the three-element set {(x), (y), (x, y)}. In other words, "x and/or y" means "one or both of x and y". As another example, "x, y, and/or z" means any element of the seven-element set {(x), (y), (z), (x, y), (x, z), (y, z), (x, y, z)}. In other words, "x, y and/or z" means "one or more of x, y and z".

As utilized herein, the terms "e.g.," and "for example" set off lists of one or more non-limiting examples, instances, or illustrations.

The terms "coupled," "coupled to," and "coupled with" as used herein, each mean a structural and/or electrical connection, whether attached, affixed, connected, joined, fastened, linked, and/or otherwise secured. As used herein, the term "attach" means to affix, couple, connect, join, fasten, link, and/or otherwise secure. As used herein, the term "connect" means to attach, affix, couple, join, fasten, link, and/or otherwise secure.

The terms "about" and/or "approximately," when used to modify or describe a value (or range of values), position, orientation, and/or action, mean reasonably close to that value, range of values, position, orientation, and/or action. Thus, the examples described herein are not limited to only the recited values, ranges of values, positions, orientations, and/or actions but rather should include reasonably workable deviations.

As used herein the terms "circuits" and "circuitry" refer to physical electronic components (i.e., hardware) and any software and/or firmware ("code") which may configure the hardware, be executed by the hardware, and or otherwise be associated with the hardware. As used herein, for example, a particular processor and memory may comprise a first "circuit" when executing a first one or more lines of code and may comprise a second "circuit" when executing a second one or more lines of code. As utilized herein, circuitry is "operable" and/or "configured" to perform a function whenever the circuitry comprises the necessary hardware and/or code (if any is necessary) to perform the function, regardless of whether performance of the function is disabled or enabled (e.g., by a user-configurable setting, factory trim, etc.).

As used herein, a control circuit may include digital and/or analog circuitry, discrete and/or integrated circuitry, microprocessors, DSPs, etc., software, hardware and/or firmware, located on one or more boards, that form part or all of a controller, and/or are used to control a welding process, and/or a device such as a power source or wire feeder.

As used herein, the term "processor" means processing devices, apparatus, programs, circuits, components, systems, and subsystems, whether implemented in hardware, tangibly embodied software, or both, and whether or not it is programmable. The term "processor" as used herein includes, but is not limited to, one or more computing devices, hardwired circuits, signal-modifying devices and systems, devices and machines for controlling systems, central processing units, programmable devices and systems, field-programmable gate arrays, application-specific integrated circuits, systems on a chip, systems comprising discrete elements and/or circuits, state machines, virtual machines, data processors, processing facilities, and combinations of any of the foregoing. The processor may be, for example, any type of general purpose microprocessor or microcontroller, a digital signal processing (DSP) processor, an application-specific integrated circuit (ASIC). The processor may be coupled to, and/or integrated with a memory device.

As used, herein, the term "memory" and/or "memory device" means computer hardware or circuitry to store information for use by a processor and/or other digital device. The memory and/or memory device can be any suitable type of computer memory or any other type of electronic storage medium, such as, for example, read-only memory (ROM), random access memory (RAM), cache memory, compact disc read-only memory (CDROM), electro-optical memory, magneto-optical memory, programmable read-only memory (PROM), erasable programmable read-only memory (EPROM), electrically-erasable programmable read-only memory (EEPROM), a computer-readable medium, or the like.

Example Gaming System and Electronic Gaming Machines

FIG. 1 illustrates a system 100 in a gaming environment. As shown, the system 100 includes one or more server computers 102 (e.g., slot servers of a casino) that are in communication, via a communications network, with one or more EGMs 104A-104X (e.g., slots, video poker, bingo machines, and/or other gaming devices). The one or more EGMs 104A-104X comprise several different examples of EGMs which may be networked to the various gaming related server computers 102. In some examples, the EGMs 104A-104X may alternatively be portable and/or remote gaming devices such as, but not limited to, a smart phone, a tablet, a laptop, or a game console.

Communication between the EGMs 104A-104X and the server computers 102, and among the EGMs 104A-104X, may be direct or indirect, such as over the Internet through a website maintained by a computer on a remote server or over an online data network including commercial online service providers, Internet service providers, private networks, and the like. In other examples, the EGMs 104A-104X may communicate with one another and/or the server computers 102 over RF, cable TV, satellite links and the like.

In some examples, server computers 102 may not be necessary and/or preferred. For example, the present disclosure may, in one or more examples, be practiced on a stand-alone EGM such as EGM 104A, EGM 104B or any of the other EGMs 104C-104X. However, in some examples, multiple EGMs may be connected to networks implemented with one or more of the different server computers 102 described herein.

In the example of FIG. 1, the server computers 102 include a central determination gaming system server 106, a bingo server 107, a ticket-in-ticket-out (TITO) system server 108, a player tracking system server 110, a progressive system server 112, and a casino management system server 114. In some examples, more or less server computers 102 may be used. In some examples, EGMs 104A-104X may include features to enable operation of any or all server computers 102 for use by the player and/or operator (e.g., the casino, resort, gaming establishment, tavern, pub, etc.). For example, game outcomes may be generated and/or determined on the central determination gaming system server 106 and then transmitted over the network to any of a group of remote terminals or remote EGMs 104A-104X that utilize the game outcomes and display the results to the players. In some examples, bingo game outcomes (e.g., for Class II games) may be generated and/or determined on the bingo server 107 and then transmitted over the network to any the EGMs 104A-104X.

In the example of FIG. 1, EGM 104A is of a cabinet construction which may be aligned in rows or banks of similar devices for placement and operation on a casino floor. The EGM 104A includes a main door 116 which provides access to the interior of the cabinet. As shown, the EGM 104A also includes a button area or button deck 120 accessible by a player that is configured with input switches or buttons 122, an access channel for a bill validator 124, and/or an access channel for a ticket printer 126.

In FIG. 1, EGM 104A is shown as a Relm XL™ model EGM manufactured by Aristocrat® Technologies, Inc. As shown, EGM 104A is a reel machine having a gaming display area 118 comprising a number (typically 3 or 5) of mechanical reels 130 with various symbols displayed on them. The reels 130 are independently spun and stopped to show a set of symbols within the gaming display area 118 which may be used to determine an outcome to the game.

In some examples, the EGM 104A may have a main display 128 (e.g., video display monitor) mounted to, or above, the gaming display area 118. The main display 128 can be a high-resolution LCD, plasma, LED, or OLED panel which may be flat or curved as shown, a cathode ray tube, or other conventional electronically controlled video monitor.

In some examples, the bill validator 124 may also function as a "ticket-in" reader that allows the player to use a casino issued credit ticket to load credits onto the EGM 104A (e.g., in a cashless ticket ("TITO") system). In such cashless examples, the EGM 104A may also include a "ticket-out" printer 126 for outputting a credit ticket when a "cash out" button is pressed. Cashless TITO systems are well known in the art and are used to generate and track unique bar-codes or other indicators printed on tickets to allow players to avoid the use of bills and coins by loading credits using a ticket reader and cashing out credits using a ticket-out printer 126 on the EGM 104A.

In some examples, a player tracking card reader 144, a transceiver for wireless communication with a player's smartphone, a keypad 146, and/or an illuminated display 148 for reading, receiving, entering, and/or displaying player tracking information is provided in EGM 104A. In such examples, a game controller within the EGM 104A can communicate with the player tracking server system 110 to send and receive player tracking information.

EGM 104A may also include a bonus topper wheel 134. When bonus play is triggered (e.g., by a player achieving a particular outcome or set of outcomes in the primary game), bonus topper wheel 134 is operative to spin and stop with indicator arrow 136 indicating the outcome of the bonus game. Bonus topper wheel 134 is typically used to play a bonus game, but it could also be incorporated into play of the base or primary game.

A candle 138 may be mounted on the top of EGM 104A and may be activated by a player (e.g., using a switch or one of buttons 122) to indicate to operations staff that EGM 104A has experienced a malfunction or the player requires service. The candle 138 is also sometimes used to indicate a jackpot has been won and to alert staff that a hand payout of an award may be needed.

There may also be one or more information panels 152 which may be a back-lit, silkscreened glass panel with lettering to indicate general game information including, for example, a game denomination (e.g., $0.25 or $1), pay lines, pay tables, and/or various game related graphics. In some examples, the information panel(s) 152 may be implemented as an additional video display.

EGMs 104A have traditionally also included a handle 132 typically mounted to the side of main cabinet 116 which may be used to initiate game play.

Figure 2:
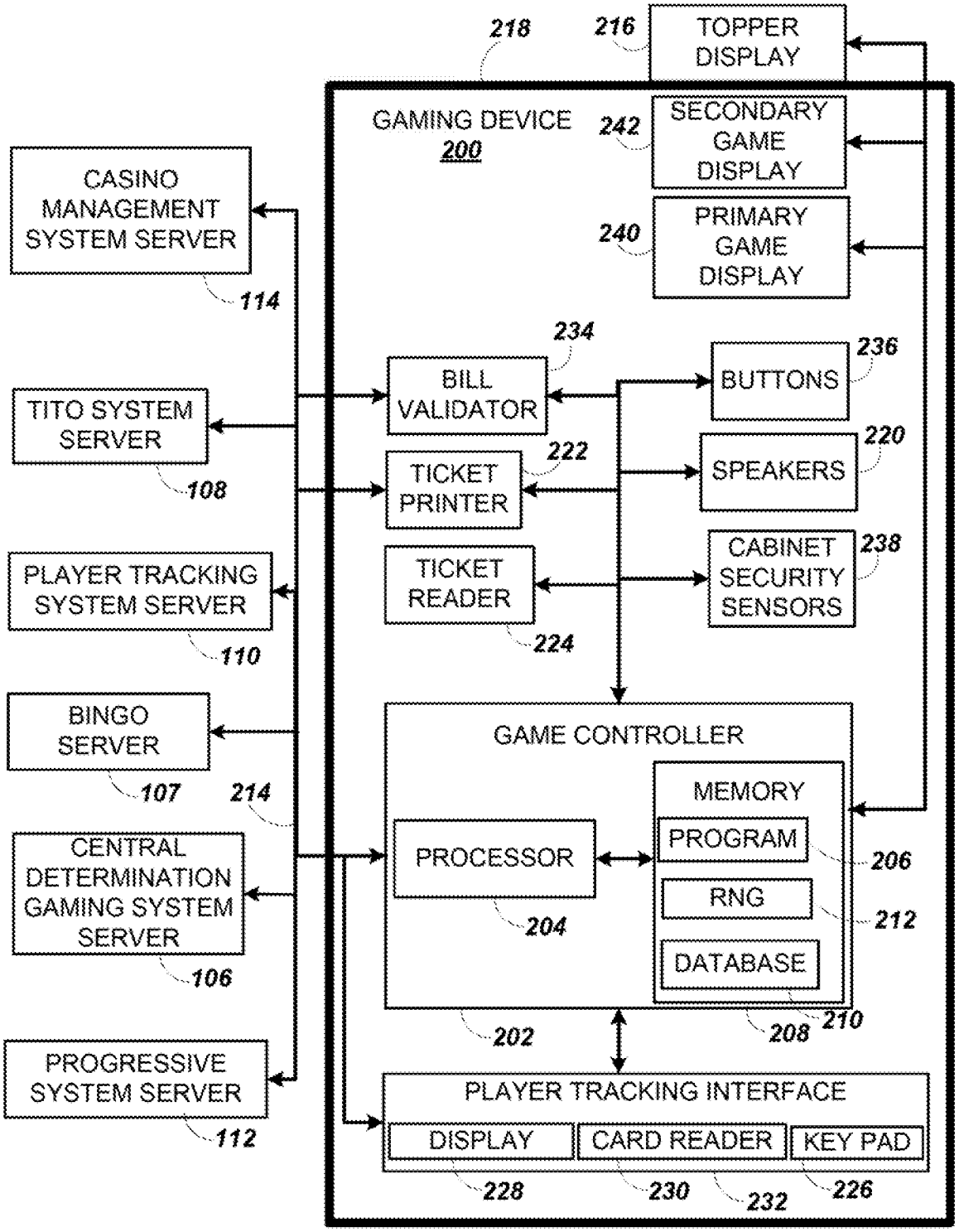
FIG. 2 is a block diagram showing various functional elements of an example EGM.

Many or all the above described components can be controlled by circuitry (e.g., a gaming controller) housed inside the main cabinet 116 of the EGM 104, the details of which are shown in FIG. 2.

Note that not all EGMs suitable for implementing examples of the present disclosure necessarily include top wheels, top boxes, information panels, cashless ticket systems, and/or player tracking systems. Further, some suitable EGMs have only a single game display that includes only a mechanical set of reels and/or a video display, while others are designed for bar counters or table tops and have displays that face upwards.

An alternative example EGM 104B illustrated in FIG. 1 is the Arc™ model EGM manufactured by Aristocrat® Technologies, Inc. Note that where possible, reference numerals identifying similar features of the EGM 104A example are also identified in the EGM 104B example using the same reference numbers. EGM 104B does not include physical reels and instead shows game play functions on main display 128. An optional topper screen 140 may be used as a secondary game display for bonus play, to show game features or attraction activities while a game is not in play, or any other information or media desired by the game designer or operator. In some examples, topper screen 140 may also or alternatively be used to display progressive jackpot prizes available to a player during play of EGM 104B.

Example EGM 104B includes a main cabinet 116 including a main door 116 which opens to provide access to the interior of the EGM 104B. The main or service door 116 is typically used by service personnel to refill the ticket-out printer 126 and collect bills and tickets inserted into the bill validator 124. The door 116 may also be accessed to reset the machine, verify and/or upgrade the software, and for general maintenance operations.

Another example EGM 104C shown is the Helix™ model EGM manufactured by Aristocrat® Technologies, Inc. EGM 104C includes a main display 128A that is in a landscape orientation. Although not illustrated by the front view provided, the landscape display 128A may have a curvature radius from top to bottom, or alternatively from side to side. In some examples, display 128A is a flat panel display. Main display 128A is typically used for primary game play while secondary display 128B is typically used for bonus game play, to show game features or attraction activities while the game is not in play or any other information or media desired by the game designer or operator.

Many different types of games, including mechanical slot games, video slot games, video poker, video black jack, video pachinko, keno, bingo, and lottery, may be provided with or implemented within the depicted EGMs 104A-104C and other similar EGMs. Each EGM may also be operable to provide many different games. Games may be differentiated according to themes, sounds, graphics, type of game (e.g., slot game vs. card game vs. game with aspects of skill), denomination, number of paylines, maximum jackpot, progressive or non-progressive, bonus games, and may be deployed for operation in Class II or Class III, etc.

FIG. 2 is a block diagram depicting example internal electronic components of an EGM 200 connected to various external systems. All or parts of the example EGM 200 shown could be used to implement any one of the example EGMs 104A-104X depicted in FIG. 1. In some examples, the games available for play on the EGM 200 are controlled by a game controller 202. In the example of FIG. 2, the game controller 202 includes one or more processors 204 coupled to memory 208, which may be used to store game software or a program 206, for example. The memory 208 may include one or more mass storage devices or media that are housed within EGM 200. Within the mass storage devices and/or memory 208, one or more databases 210 may be provided for use by the program 206. A random number generator (RNG) 212 that can be implemented in hardware and/or software may be used to generate random numbers that are used in the operation of game play to ensure that game play outcomes are random and meet regulations for a game of chance.

In some examples, a game instance (i.e. a play or round of the game) may alternatively be generated on a remote gaming device such as a central determination gaming system server 106. The game instance may be communicated to EGM 200 via the network 214 and then displayed on EGM 200. In some examples, such as during the play of Class II bingo, a game instance may be generated using bingo server 107. For example, the bingo server 107 may generate a set of bingo numbers (e.g., a ball call), provide the bingo numbers to EGM 200 to compare with bingo card numbers, and/or determine a bingo game award that may then be displayed via the EGM 200. In some examples, a keno game instance (rather than a bingo game instance) may be generated using bingo server 107. In some examples, the bingo server 107 may be implemented and/or embodied in one of the other server computers 102.

EGM 200 may execute game software, such as but not limited to video streaming software that allows the game to be displayed on EGM 200. When a game is stored on EGM 200, it may be loaded from a memory 208 (e.g., from a read only memory (ROM)) or from a server computer 102 to memory 208. The memory 208 may include RAM, ROM or another form of storage media that stores instructions for execution by the processor 204.

The EGM 200 may include a topper display 216 or another form of a top box (e.g., a topper wheel, a topper screen, etc.) which sits above main cabinet 218. The gaming cabinet 218 or topper display 216 may also house a number of other components which may be used to add features to a game being played on EGM 200, including speakers 220, a ticket printer 222 which prints bar-coded tickets or other media or credit input mechanisms for storing or indicating a player's credit value, a ticket reader 224 which reads bar-coded tickets or other media or mechanisms for storing or indicating a player's credit value, and a player tracking interface 232. The player tracking interface 232 may include a keypad 226 for entering information, a player tracking display 228 for displaying information (e.g., an illuminated or video display), a card reader 230 for receiving data and/or communicating information to and from media, or a device, such as a smart phone enabling player tracking, or other physical items such as a player card. Ticket printer 222 may be used to print tickets for a TITO system server 108, or as a payout mechanism to print award tickets to a player. The EGM 200 may further include a bill validator 234 for receiving a physical item representing a monetary value for establishing a credit balance, buttons 236 for player input, cabinet security sensors 238 to detect unauthorized opening of the cabinet 218, a primary game display 240, and a secondary game display 242, each coupled to and operable under the control of game controller 202.

EGM 200 may be connected over network 214 to player tracking system server 110. Player tracking system server 110 may be, for example, an OASIS® system manufactured by Aristocrat® Technologies, Inc. Player tracking system server 110 may be used to track play (e.g. amount wagered, games played, time of play and/or other quantitative or qualitative measures) for individual players so that an operator may reward players in a loyalty program. The player may use the player tracking interface 232 to access his/her account information, activate free play, and/or request various information. Player tracking or loyalty programs seek to reward players for their play and help build brand loyalty to the gaming establishment. The rewards typically correspond to the player's level of patronage (e.g., to the player's playing frequency and/or total amount of game plays at a given casino). Player tracking rewards may be complimentary and/or discounted meals, lodging, entertainment and/or additional play. Player tracking information may be combined with other information that is now readily obtainable by a casino management system.

In some examples, EGMs 104A-104X, 200 are configured to award monetary rewards (e.g., in the form of a redeemable voucher, hard currency, etc.). As such, EGMs 104A-104X (and/or 200) may be highly regulated to ensure fairness. Therefore, to satisfy security and regulatory requirements in a gaming environment, hardware and software architectures may be implemented in EGMs 104A-104X, 200 that differ significantly from those of general-purpose computers. Adapting general purpose computers to function as EGMs 200 is not simple or straightforward because of: 1) the regulatory requirements for EGMs 200, 2) the harsh environment in which EGMs 200 operate, 3) security requirements, 4) fault tolerance requirements, and 5) the requirement for additional special purpose componentry enabling functionality of an EGM. These differences require substantial engineering effort with respect to game design implementation, hardware components and software.

General Operation

When a player wishes to play the EGM 200, he/she can insert cash or a ticket voucher through a coin acceptor (not shown) or bill validator 234 to establish a credit balance on the gamine machine. The credit balance is used by the player to place wagers on instances of the game and to receive credit awards based on the outcome of winning instances. The credit balance is decreased by the amount of each wager and increased upon a win. The player can add additional credits to the balance at any time. The player may also optionally insert a loyalty club card into the card reader 230. During the game, the player views the game outcome on the game displays 240, 242. Other game and prize information may also be displayed.

For each game instance, a player may make selections, which may affect play of the game. For example, the player may vary the total amount wagered by selecting the amount bet per line and the number of lines played. In some games, the player is asked to initiate or select options during course of game play (such as spinning a wheel to begin a bonus round or select various items during a feature game). The player may make these selections using the player-input buttons 236, the primary game display 240 which may be a touch screen, and/or using some other device which enables a player to input information into the EGM 200.

During certain game events, the EGM 200 may display visual and auditory effects that can be perceived by the player. These effects add to the excitement of a game, which makes a player more likely to enjoy the playing experience. Auditory effects may include various sounds that are projected by the speakers 220. Visual effects may include flashing lights, strobing lights or other patterns displayed from lights on the EGM 200 or from lights behind the information panel 152 (FIG. 1). In some examples, the input and/or output mechanisms of the EGM 200 (e.g., the lights, speakers 220, displays 240, 242, keypad 226, input buttons 236, etc.) may comprise a user interface.

When the player is done playing, he/she may cash out the credit balance (e.g., by pressing a cash out button to receive a ticket from the ticket printer 222). The ticket may be "cashed-in" for money or inserted into another machine to establish a credit balance for play. In some examples, the player receive game credits, game tokens from a credit output mechanism such as a coin tray (not shown), which may be used for further games or to redeem a prize. In some examples, the player may receive a ticket for food, merchandise, and/or games from ticket printer 222.

Class II Game Operation

Figure 3:
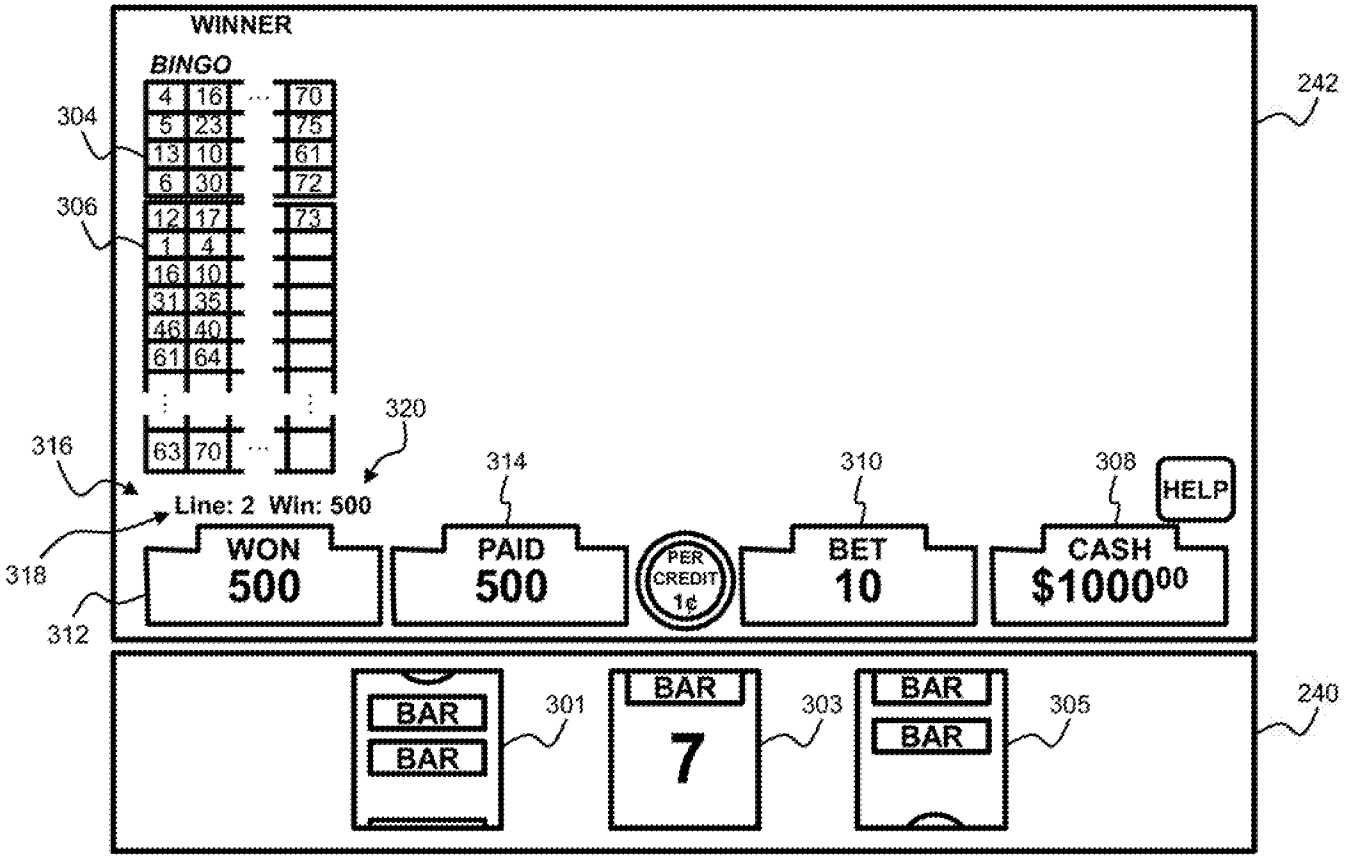
FIG. 3 is an example of a Class II game being displayed in a normal mode via an EGM.

FIG. 3 depicts an example of a Class II bingo game being displayed in the primary game display 240 and secondary game display 242 of the EGM 200 of FIG. 2. In the example of FIG. 3, a plurality of reels 301, 303, and 305 are displayed within the primary game display 240. While only three reels 301, 303, 305 are shown in the example of FIG. 3, in some examples, more or fewer reels may be used. In some examples, the reels 301, 303, and/or 305 may be implemented as mechanical reels. As shown, each reel 301, 303, 305 has a plurality of symbol display positions for presenting symbols (and/or symbol combinations) which may be associated with winning and/or losing reel game outcomes and/or rewards.

In the example of FIG. 3, a bingo card 304 and a bingo number listing 306 are displayed in the secondary game display 242. As shown, the bingo card 304 comprises a matrix of bingo cells 302 (e.g., squares). In some examples, the matrix may be a 5×5 matrix of 25 total cells. In some examples, the bingo card 304 may have a matrix of a different size (e.g., 3×3, 4×4, 4×5, 4×6, 6×6, 7×7, 3×8, 10×10, etc.). In some examples, the matrix may be larger or smaller. In the example of FIG. 3, each cell 302 in the matrix of the bingo card 304 includes a number that is not repeated in any other cell of the bingo card 304.

In the example of FIG. 3, the secondary game display 242 further displays a credit meter 308 showing an amount of money and/or credits (e.g. credit balance) held by a player of the EGM 200. In the example of FIG. 3, the credit balance 308 shows $1000. The secondary display 242 additionally shows a wager meter 310 adjacent to the credit meter 308, under "BET." In the example of FIG. 3, the amount wagered is 10 credits (e.g., $0.10). The amount wagered (e.g., via the user interface) may be deducted from the credit meter 308. The secondary game display 242 additionally displays a win meter 312 and a total win meter 314. In the example of FIG. 3, the win meter 312 is 500, indicating that the simulated combination of symbols in reels 301, 303, 305 is associated with a 500 reward (which is equal to the reward associated with the bingo game outcome). As shown, the total win meter 314 is also 500, indicating that the cumulative total of rewards received comprises just that one 500 credit reward. In the example of FIG. 3, the secondary game display 242 further displays reel win information 316. The reel win information 316 includes win line information 318 and reward information 320. The win line information 318 indicates which win line in the reels 301, 303, 305 contains symbols comprising a winning reel game outcome. The reward information 320 indicates an associated reward amount for that winning reel game outcome.

In some examples, the bingo game may be a networked game that involves two or more networked EGMs 200. The bingo server 107 may manage (and/or host) the bingo game, such as by generating the bingo card 304 and/or bingo number listing 306. In some examples, the bingo card 304 (and/or information on which the bingo card 304 is based), and/or the bingo number listing 306 may be generated using an RNG. In some examples, the bingo card 304 may be randomly selected from a set of bingo cards or a player may select their own bingo card 304 (e.g., via the user interface), such as from a set of randomly generated bingo cards, for example.

In operation, a player and/or EGM 200 may be provided with the bingo card 304, such as by bingo server 107. For example, a player may be provided a new bingo card 304 each time a "Spin" or "Play" button is pressed by the player (e.g., via user interface), provided the player has made a wager. In some examples, more than one bingo card 304 may be generated in response to wager. The bingo number listing 306 (e.g., "ball call") may be randomly generated, such as by bingo server 107. The bingo card 304 may be compared to the current bingo number listing 306, and numbered cells 302 on the bingo card 304 that match numbers in the bingo number listing 306 may be marked or "daubed" on the bingo card 304. Finally, the marked or daubed bingo card 304 may be evaluated against a paytable of winning bingo patterns.

The bingo number listing 306 may be continually generated until a maximum amount of numbers are listed (e.g., seventy-five numbers listed) or until a game-ending pattern is awarded to a player participating in the bingo game. A typical game-ending pattern may be a bingo card blackout pattern, in which each of the numbers of a bingo card match a number displayed in the bingo number listing 306. Other game-ending patterns are also possible. When the game-ending pattern is awarded, the bingo number listing 306 is reset, and the process repeats. In some examples, a single play of the bingo game includes a wager, a bingo card, a bingo number listing 306, a matching of the numbers called with those on a bingo card 304, a determination of a bingo game outcome, and a presentation of an associated reward, if any.

A bingo game outcome may be determined by comparing one or more patterns of marked (and/or "daubed) cells of the bingo card 304 with the paytable of winning bingo patterns. If the bingo card 304 does not include a pattern that matches a pattern in the paytable of winning patterns, then a losing bingo outcome is determined, and no reward may be provided to the player. If the bingo card 304 does include a pattern that matches a pattern in the paytable of winning patterns, then a winning bingo outcome is determined, and a reward may be provided to the player.

Different winning patterns may be associated with different rewards. The reward for a winning main bingo game outcome may be based on an amount wagered, an associated main bingo game paytable, an associated set of rules for the main bingo game, a probability (and/or likelihood) of achieving a particular bingo pattern/combination, an amount of bingo numbers needed to achieve the particular bingo pattern/combination, and/or other considerations. In some examples, the player may be awarded for multiple patterns (e.g. all winning patterns) that are matched when the bingo card 304 is evaluated against the paytable of winning patterns. In some examples, the player may be rewarded for only the highest priority pattern (e.g. the highest paying winning pattern) that is matched. In some examples, during play of a Class II game, a player is provided or selects a single bingo card 304 for multiple plays of the bingo game, with a new bingo number listing 306 generated for each play of the bingo game. Other methods of play of a Class II bingo game are also possible and are within the scope of this disclosure.

The bingo game outcome may be presented to the player via a spinning reel game simulation. In the example of FIG. 3, the spinning reel game is simulated via the plurality of reels 301, 303 and 305 in the primary game display 240. For each play of the bingo game, the bingo game outcome is presented as a reel spin outcome in the reel game. In some examples, the spinning reel game simulation may operate by spinning each reel 301, 303, 305 and then stopping each reel 301, 303, 305 in a particular position to obtain a matrix of symbols. One or more combinations of symbols in the matrix of symbols may be associated with a reel game outcome that is equal to the main bingo game outcome. For example, a winning bingo game outcome may be displayed as a winning combination of reels 301, 303 and 305. Similarly, a losing bingo game outcome may be displayed as a losing combination of reels 301, 303 and 305. Different outcomes of the bingo game may be displayed as different outcomes in the spinning reel game. Thus, the bingo game outcome is presented to the player as a particular reel spin outcome of reels 301, 303 and 305.

Free Spin Multipliers

In some examples, the spinning reel game may simulate a feature mode, such as a free spin (and/or free play) feature mode, when one or more conditions are satisfied. In some examples, a particular bingo game outcome may trigger the free spin feature mode. For example, a paytable of the bingo game may have one or more flags associated with one or more bingo game winning patterns, and the free spin feature mode may be triggered when a player's bingo card 304 has a pattern that matches one of the flagged patterns. As another example, the free spin feature mode may be triggered by a winning bingo pattern with a priority higher (or lower) than a certain threshold. In some examples, the free spin feature mode may be triggered when there are more than one (e.g., 2, 3, 4, 5, etc.) bingo game winning patterns.

During the free spin feature mode several "free spins" of the spinning reel game may be simulated, and the bingo game outcome(s) (and/or bingo reward(s)) may be presented to the player via the several "free spin" outcomes (and/or rewards). In some examples, each spinning reel game outcome during the free spin feature mode may be a winning outcome, with an associated spinning reel game reward. The sum of the one or more spinning reel game rewards may be equal to the bingo game reward (and/or sum of bingo rewards).

In some examples, each spinning reel game reward may include a base reward and a multiplier. In some examples, the multiplier is always one (i.e., 1×) during regular play (i.e., not in free spin mode), and one or more (e.g., 1×, 2×, 3×, 4×, 5×, 10×, etc.) during free spin mode. The scarcity of multipliers during regular play may increase player engagement and/or enjoyment during free spin mode. The multipliers may be highlighted and/or emphasized when greater than one (e.g., through fireworks, explosions, color schemes, bolding, font size, etc.).

Conventionally, rewards are presented in increasing order of the total reward. This is normally straightforward. However, with multipliers, both the base reward and the total reward (base×multiplier) must be considered. In particular, research indicates that player satisfaction and/or player excitement may diminish if the base rewards decrease during the simulation. For instance, player excitement may diminish if a player is presented with a reel combination (e.g., 7*s*) associated with a higher base reward, and then the player is subsequently presented with a reel combination (e.g., BARs) associated with a lower base reward. This diminishing effect may occur even if both total rewards are the same, or the second total reward is higher than the first total reward. The present disclosure therefore contemplates simulating the reel game such that reel game outcomes are presented sequentially according to their associated base rewards, with the lowest base reward occurring first and the highest base reward presented last, so as to maximize player satisfaction, excitement, enjoyment, and/or engagement. In some examples, reel game outcomes with the same base reward may also be presented sequentially according to their multipliers, with the lowest multiplier occurring first and the highest multiplier presented last. In some examples, the reel game may instead be simulated to present reel game outcomes sequentially according to their overall reward or multiplier.

FIG. 3 is an example of a Class II bingo game in normal mode. In the example of FIG. 3, the secondary game display 242 displays reel win information 316 corresponding to the reel game simulated via the reels 301, 303, 305. As shown, the reel win information 316 shows that win line 2 of the reels 301, 303, 305 comprises a winning combination with a base reward amount of 500 credits. Since FIG. 3 is an example of normal mode of the spinning reel game simulation, the multiplier is always 1×, and there is only one simulated spin of the reels 301, 303, 305. Thus, the total win meter 314 shows the same reward amount as the win meter 312 (i.e., 500 credits).

FIGS. 4-9 are examples of a Class II bingo game being displayed in feature (and/or "free spin" or "red spin") mode. In FIGS. 4-9, the feature mode has already been triggered, and the bingo game reward associated with the bingo game outcome that triggered the feature mode will be presented to the player via several "free spins" of the feature mode reel game simulation. The total payout that will be presented is 4500 credits, such as shown in the total win meter 314 of FIGS. 8 and 9. A feature message 322 is displayed in the secondary display 242 to indicate to the player that the feature mode is active.

Figure 4:
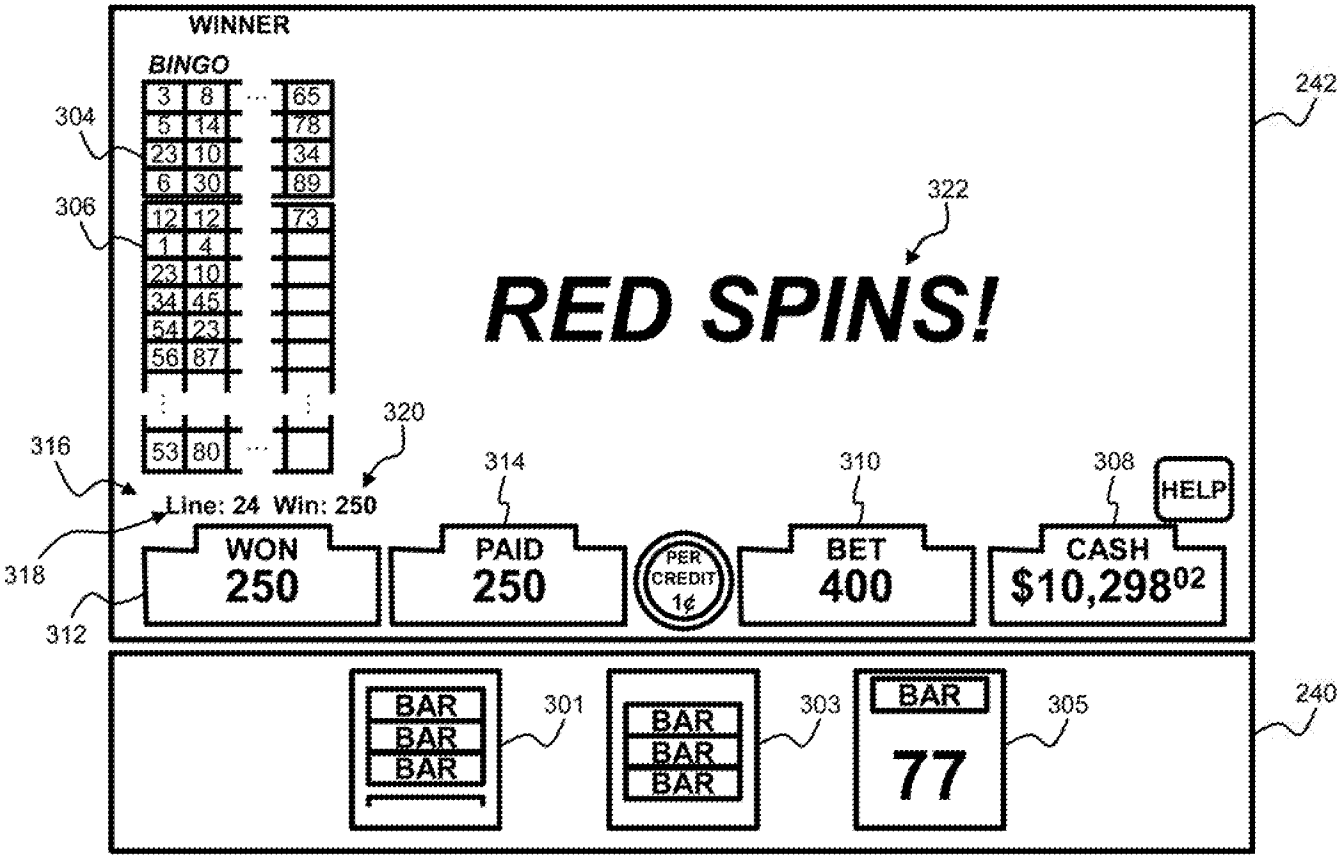
FIGS. 4-9 are examples of a Class II game being displayed in a feature mode via an EGM.

In the example of FIG. 4, the player is presented with a symbol combination in the reels 301, 303, 305. The reel win information 316 indicates that the symbol combination corresponds to a base win of 250 credits. More particularly, the symbol combination in win line 24 of the reels 301, 303, 305 corresponds to the base reward of 250 credits. No multiplier (or a multiplier of 1×) is applied to the base reward, so the total reward shown in the win meter 312 is also 250 credits. As this is the first win of the feature mode, the total win meter 314 is also 250 credits. Since the player is presented with sequential base rewards, beginning with the lowest, 250 credits will be the lowest base reward presented to the player during this feature mode reel game simulation.

Figure 5:
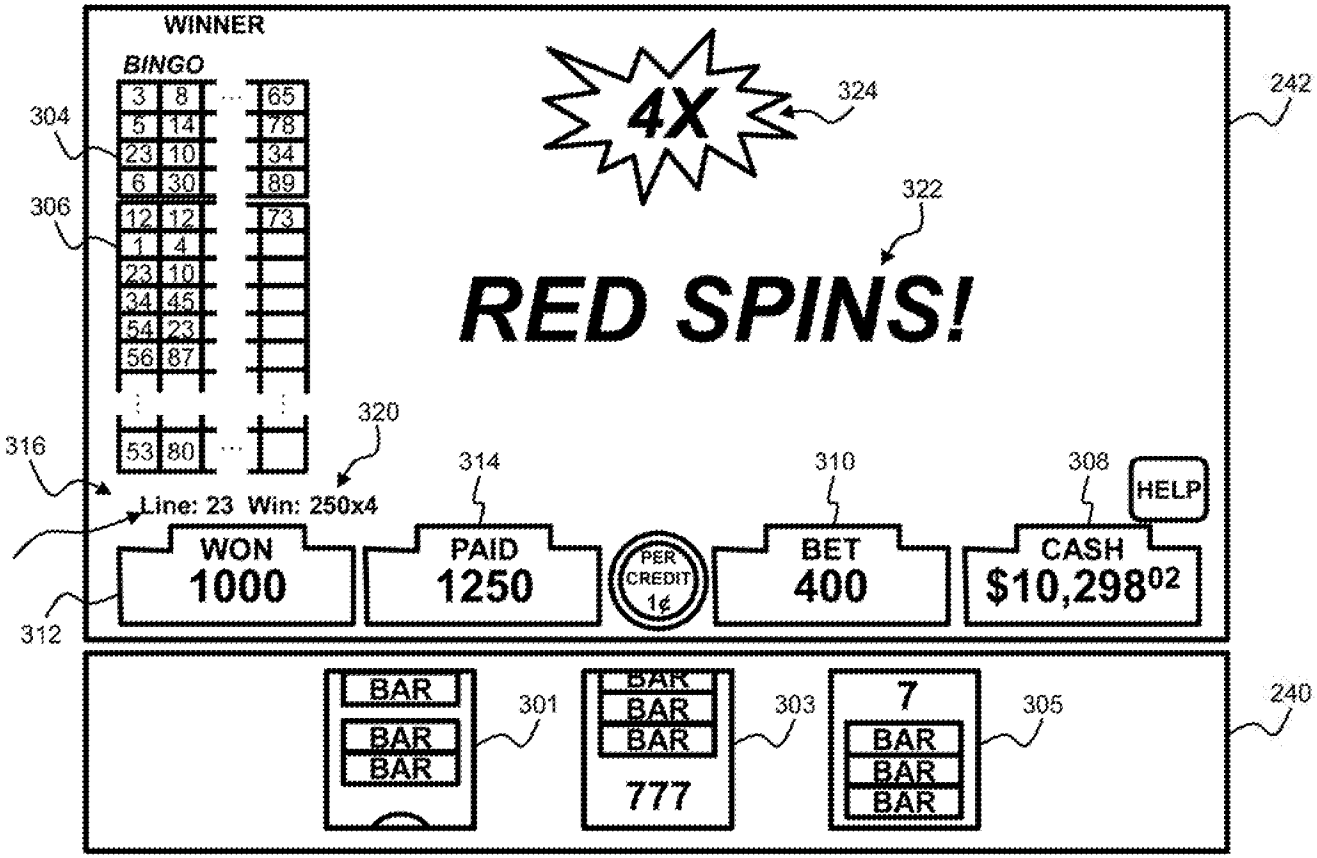

In the example of FIG. 5, the reel win information 316 indicates that the symbol combination in the reels 301, 303, 305 again corresponds to a base win of 250 credits. More particularly, the symbol combination in win line 23 of the reels 301, 303, 305 corresponds to the base reward of 250 credits. However, this time the reel win information 316 indicates that a 4× multiplier is applied to the base reward to make a total reward of 1000, as shown in the win meter 312. In the example of FIG. 5, a multiplier message 324 is prominently presented to the player above the feature mode message 322 in the secondary display 242 to indicate that the multiplier has been applied. In some examples, the multiplier message 324 may be animated, emphasized, and/or highlighted (e.g., through fireworks, explosions, color schemes, bolding, font size, etc.). Because the 4× multiplier is applied to the 250 credit base reward, the total reward amount shown in the win meter 312 is 1000 credits in FIG. 5. As this is the second win of the feature mode, the win meter 312 of FIG. 5 is added to the previous total win meter 314 of FIG. 4, to produce the 1250 credits shown in the total win meter 314.

Figure 6:
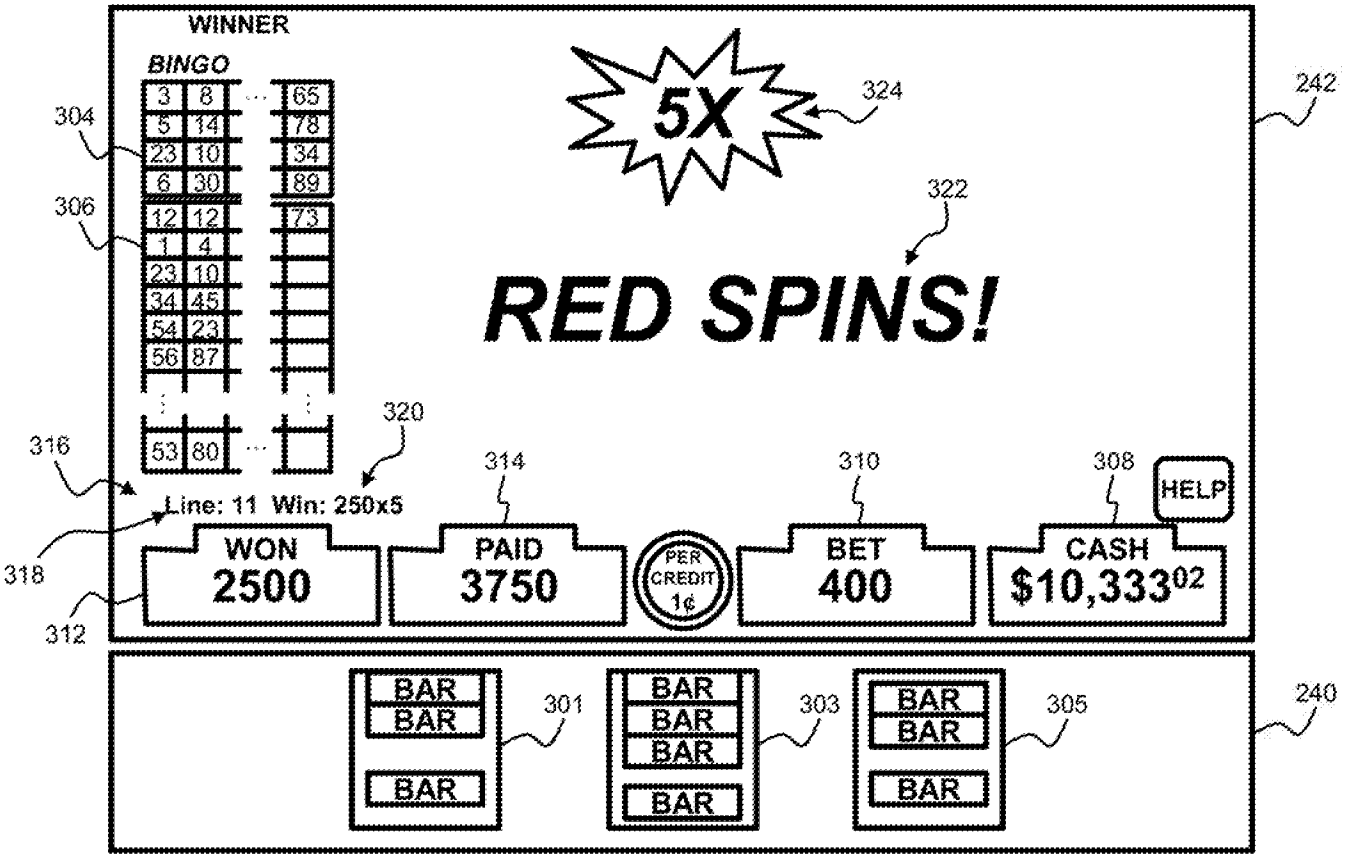
Figure 7:
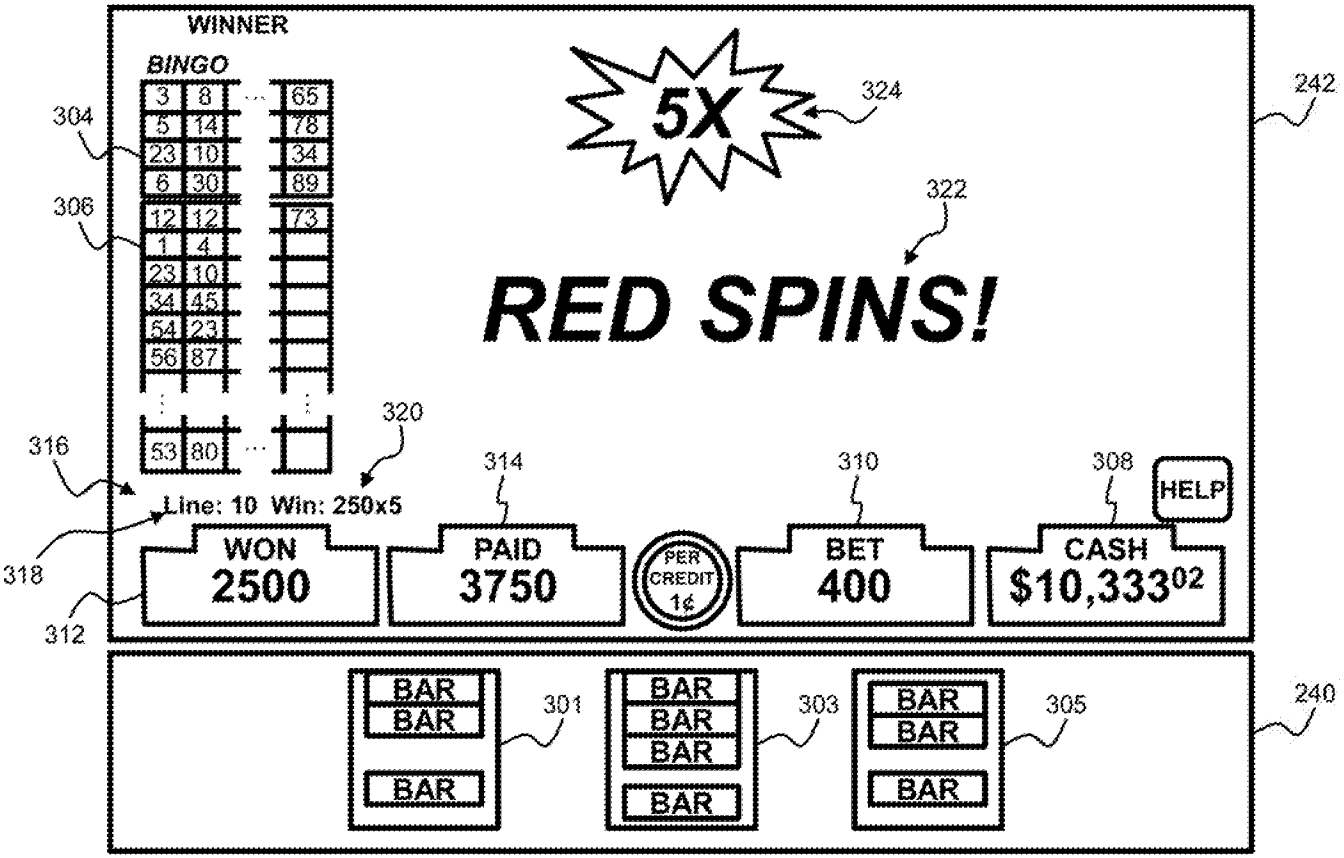

FIGS. 6 and 7 show examples where the player is presented with multiple winning symbol combinations (and/or winning outcomes) for the same spin of the reels 301, 303, 305. The reel win information 316 in the examples of both FIGS. 6 and 7 indicates that the symbol combination in the reels 301, 303, 305 corresponds to a base reward of 250 credits. In the example of FIG. 6, the reel win information 316 identifies win line 11 of the reels 301, 303, 305 as comprising the first winning symbol combination. As shown, the first winning symbol combination of win line 11 corresponds to the base reward of 250 credits, as indicated in the reward information 320. In the example of FIG. 7, the reel win information 316 identifies win line 10 in the reels 301, 303, 305 as comprising the second winning symbol combination, which corresponds to another base reward of 250 credits, as indicated in the reward information 320. In the examples of both FIGS. 6 and 7, the reel win information 316 and multiplier message 324 indicates a 5× multiplier has been applied. The multiplier is applied to both 250 credit base rewards, resulting in a total reward of 2500 credits (2500=5× (250+250)), as shown in the win meter 312. As this is the third win of the feature mode, the win meter 320 of FIGS. 6 and 7 is added to the previous total win meter 314 of FIG. 5, to make 3750 credits, as shown in the total win meter 314 of FIGS. 6 and 7.

Figure 8:
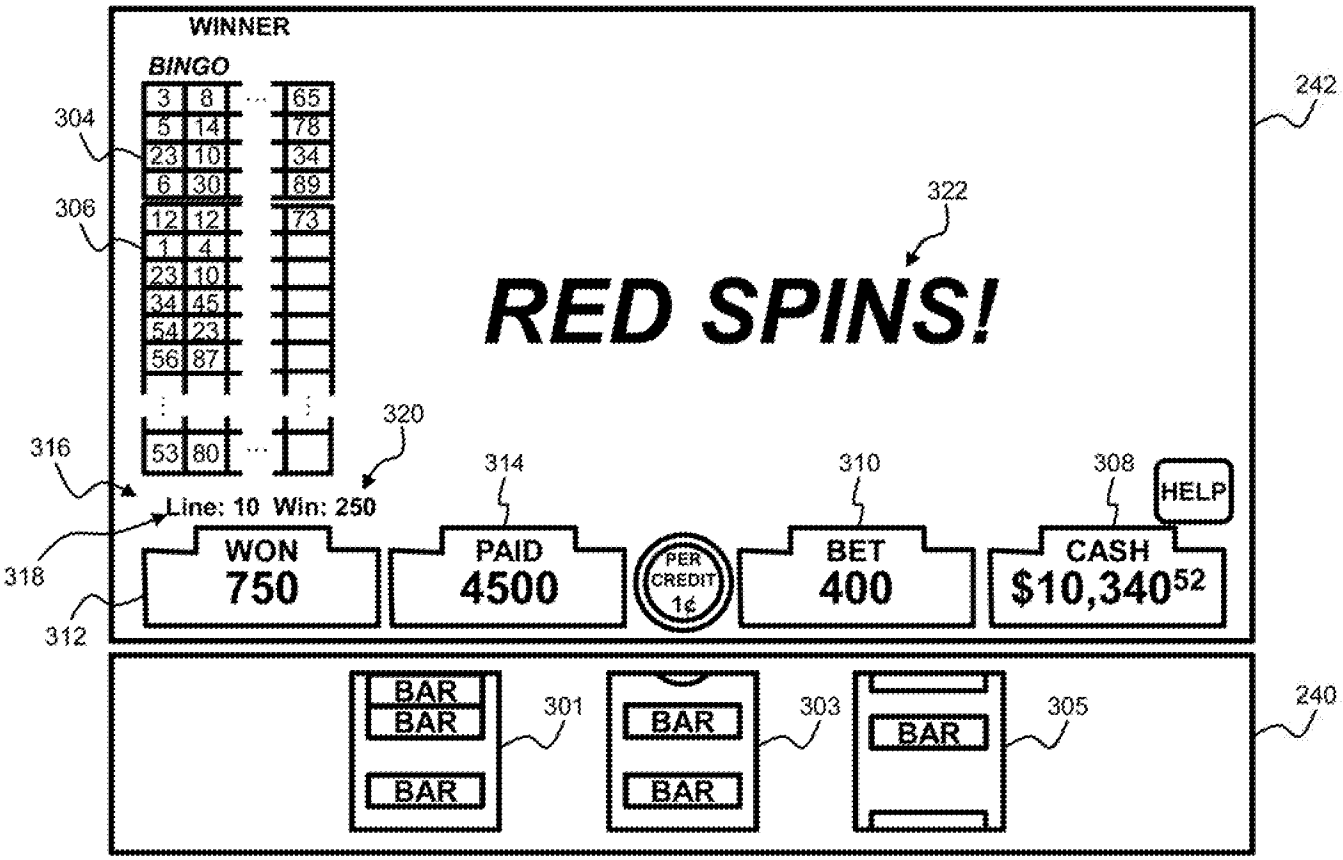
Figure 9:
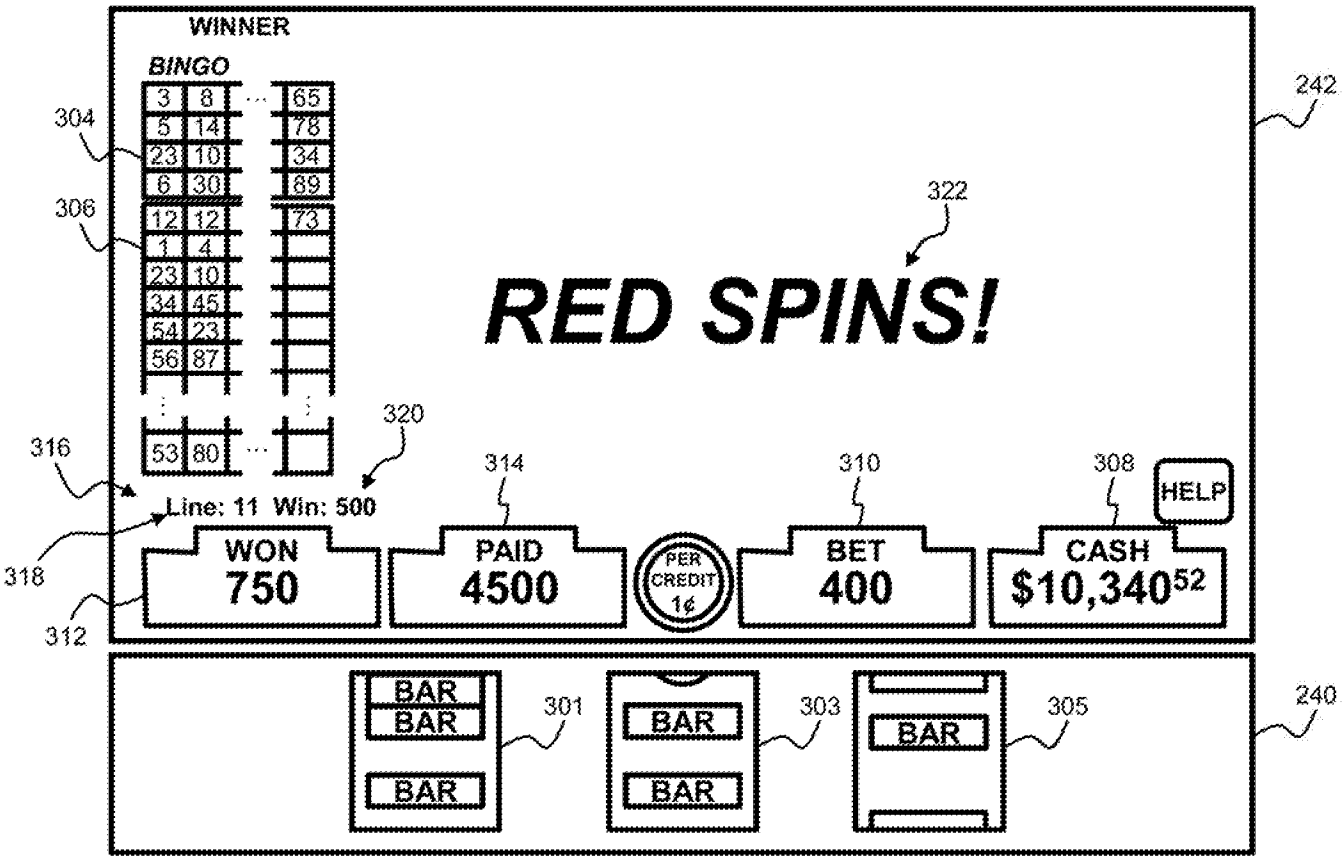

FIGS. 8 and 9 show another example where the player is presented with multiple winning symbol combinations (and/or winning outcomes) for the same spin of the reels 301, 303, 305. However, in FIGS. 8 and 9, there is no multiplier, and the base rewards are different. In particular, the reel win information 316 in the example of FIG. 8 indicates that the symbol combination in the reels 301, 303, 305 corresponds to a base reward of 250 credits. In contrast, the reel win information 316 in the example of FIG. 9 indicates that the symbol combination in the reels 301, 303, 305 corresponds to a base reward of 500 credits. In the example of FIG. 8, the reel win information 316 identifies win line 10 in the reels 301, 303, 305 as comprising the first winning symbol combination corresponding to the base reward of 250 credits. In the example of FIG. 9, the reel win information 316 identifies win line 11 in the reels 301, 303, 305 as comprising the second winning symbol combination corresponding to the base reward of 500 credits. Thus, the total reward shown in the win meter 312 of both FIGS. 8 and 9 is 750 credits (750=500+250). As this is the fourth win of the feature mode, the win meter 312 of FIGS. 8 and 9 is added to the previous total win meter 314 of FIGS. 6 and 7, to produce a new total of 4500 displayed in the total win meter 314 of FIGS. 8 and 9, which is the same as the total reward for the winning bingo game outcome(s).

Figure 10:
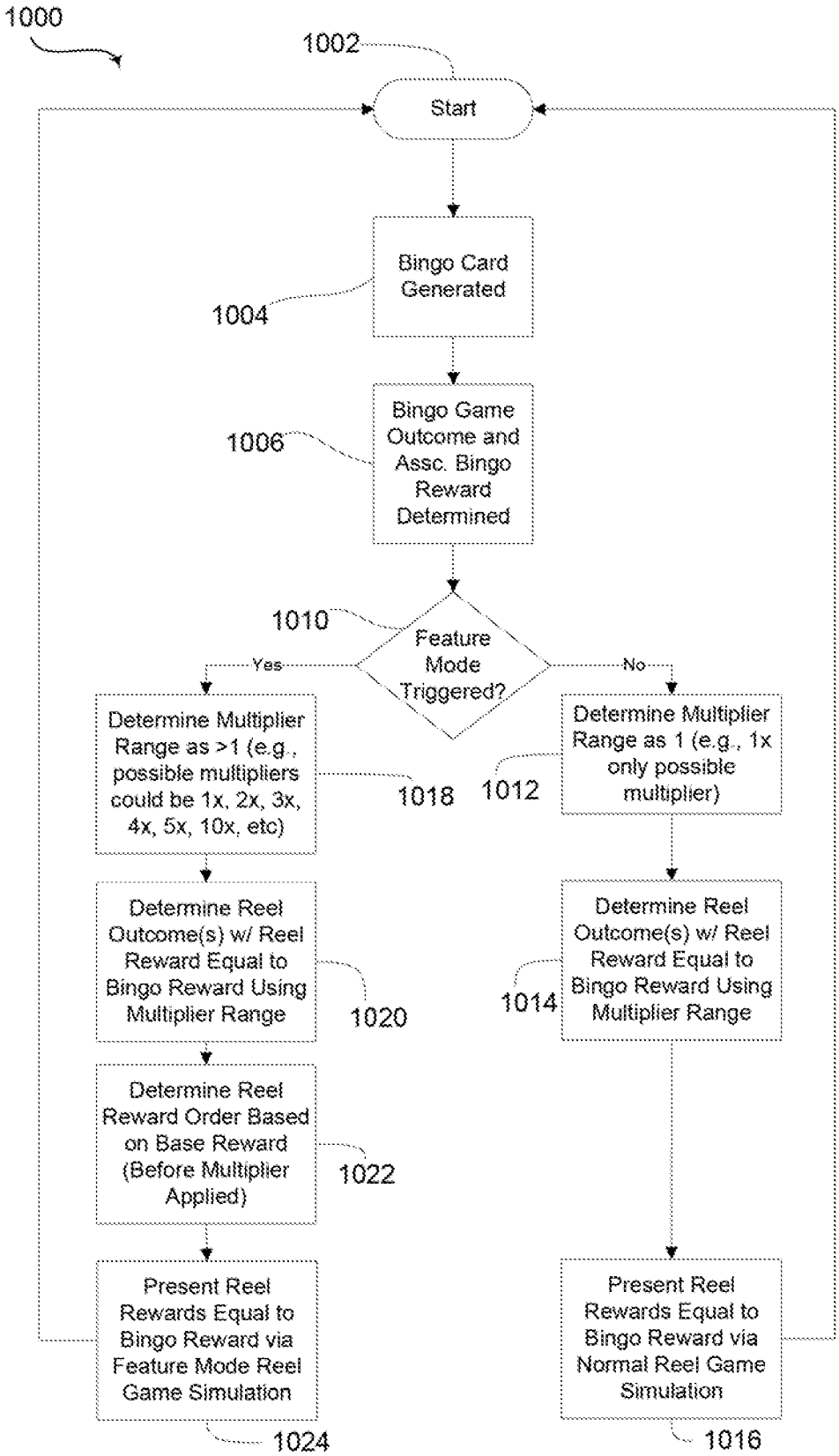
FIG. 10 is an example of a control process that may be used to conduct the Class II game.

FIG. 10 is a flow chart illustrating an example feature mode control process 1000 of the system 100. In some examples, some or all of control process 1000 may be implemented via the bingo server 107. In some examples, some or all of control process 1000 may be implemented via an EGM 200. In some examples, some or all of control process 1000 may be implemented in analog and/or discrete circuitry. In some examples, some or all of the control process 1000 may be implemented in machine readable instructions stored in memory (e.g., memory 208) and/or executed by one or more processors (e.g. processor(s) 204). In some examples, some or all of the control process 1000 may be implemented via program 206.

In the example of FIG. 10, the control process 1000 begins at block 1002, where a bingo game begins. In some examples, the bingo game may begin when a player makes a wager (e.g., via the user interface) and/or when a player initiates the game through some activation (e.g., pressing a "Spin" or "Play" button on the user interface). At block 1004, a bingo card 304 is received or generated by an EGM 200. In some examples, the bingo server 107 may generate the bingo card 304 and/or provide the bingo card to the EGM 200, as discussed above. In some examples, the EGM 200 may generate the bingo card 304, as discussed above.

In the example of FIG. 10, one or more bingo outcomes are determined at block 1006. In some examples, determining the bingo game outcome(s) may comprise a comparison (e.g., via the bingo server 107 and/or EGM 200) of the numbered cells 302 of the bingo card 304 with a bingo number listing 306, which may be generated by the bingo server 107, for example. The comparison may be conducted by the bingo server 107 and/or the EGM 200 to determine which, if any, numbered cells of the bingo card 304 match numbers in the bingo number listing 306. The bingo server 107 and/or EGM 200 may then determine whether one or more patterns formed by the matching numbered cells of the bingo card 304 correspond to one or more patterns in an associated bingo game paytable. If so, then one or more winning bingo game outcomes are determined, with each winning bingo game outcome being associated (e.g., via the paytable) with a reward. If not, then a losing bingo game outcome is determined.

At block 1010, the bingo server 107 and/or EGM 200 determines whether a feature mode should be triggered. In some examples, the feature mode may be triggered based upon the number of bingo game winning outcomes, whether one or more winning bingo patterns correspond to one or more feature flags in the bingo game paytable, a priority of the one or more winning bingo patterns in the bingo game paytable, and/or other considerations, as discussed above. As shown, if the feature mode is not triggered (e.g., there are no or too few winning bingo game outcomes, and/or no or too few feature flags or priorities), the control process 1000 proceeds to blocks 1012-1016, where the bingo outcome(s) (and/or associated reward(s)) determined at block 1006 are presented to the player via a normal reel game simulation. If feature mode is triggered, the control process proceeds to blocks 1018-1024, where the bingo outcome(s) (and/or associated reward(s)) determined at block 1006 are presented to the player via a feature mode reel game simulation.

In the example of FIG. 10, the control process 1000 determines an available multiplier range. In some examples, the multiplier range may be a set of values corresponding to potential multipliers that may be applied to a base reward during presentation of the reel game simulation. As shown, the size of the multiplier range (and/or size of the set) is determined to be only one at block 1012 when in normal (i.e., not feature) mode. Additionally, the only value in the set may be determined to be 1×. This means that the reel game rewards presented in the reel game simulation will never be presented with a multiplier (or always presented with a 1× multiplier) while in normal mode.

In the example of FIG. 10, the size of the multiplier range set is determined to be larger than one at block 1018 when in feature mode. This means that the reel game rewards presented in the reel game simulation during feature mode may have several potential multipliers that may be applied to a base reward during presentation of the reel game simulation. Additionally, as shown in FIG. 10, many of the potential multipliers are greater than 1×. The multiplier scarcity in normal mode, and contrasting multiplier availability in feature mode, may make feature mode very effective in engaging and/or exciting players.

In the example of FIG. 10, the control process 1000 determines reel outcomes and/or associated reel rewards for the reel game simulation at blocks 1014 and 1020. As shown, the appropriate multiplier ranges determined at blocks 1012 and 1018 are used in this determination. The total reel rewards (after application of multipliers) are determined such that their sum is equal to the bingo reward (and/or sum of bingo rewards) associated with the bingo game outcome(s) determined in block 1006. In some examples, the reel outcomes and/or associated reel rewards may be predetermined based on available multipliers, bingo game outcome(s), and/or bingo game reward(s). In such an example, the determinations in blocks 1014 and 1020 may involve accessing, loading, and/or retrieving the appropriate predetermined reel outcomes and/or associated reel rewards, such as from memory 208 and/or one or more of the server computers 102. In some examples, several sets of spinning reel game facades may be scripted during development by a game designer. Each set may be comprised of one or more ordered combinations of base award/multiplier outcomes that sum to a certain bingo game reward. For example, if the bingo game reward is 4500 credits, the control process 1000 may select one reel game façade presentation from a set of several potential reel game façade presentations, each of which present a set of reel game rewards adding up to the 4500 credits.

In the example of FIG. 10, the reel outcomes (and/or associated reel rewards) are ordered (e.g., from smallest to largest) at block 1022 based on the base reward of the reel game, as discussed above. In some examples, the reel outcomes (and/or associated reel rewards) may be further ordered (e.g., from smallest to largest) based on the applied multiplier. In some examples, the reel game may instead be simulated to present reel game outcomes sequentially according to their overall reward or multiplier While block 1022 is only shown as applying in feature mode in the example of FIG. 10, in some examples, a similar ordering may take place in normal mode as well. At blocks 1016 and 1024, the reel game simulations are presented to the player in feature/normal mode, using the predetermined (and potentially multiplied) reel game outcomes and in the potentially predetermined ordering. As shown, the control process 1000 reverts back to the start block 1002 after blocks 1016 and/or 1024.

As indicated above, the control process 1000 may be embodied in program code. The program code could be supplied in a number of ways, for example on a tangible computer readable storage medium, such as a disc or a memory device, e.g. an EEPROM, (for example, that could replace part of memory 103) or as a data signal (for example, by transmitting it from a server). Further different parts of the program code can be executed by different devices, for example in a client server relationship. Persons skilled in the art will appreciate that program code provides a series of instructions executable by the processor.

It will be understood to persons skilled in the art that many modifications may be made without departing from the spirit and scope of the disclosure. In particular, it will be apparent that certain features of examples of the disclosure can be employed to form further examples.

In the claims which follow and in the preceding description, except where the context requires otherwise due to express language or necessary implication, the word "comprise" or variations such as "comprises" or "comprising" is used in an inclusive sense, i.e. to specify the presence of the stated features but not to preclude the presence or addition of further features in various examples of the disclosure.

What is claimed is:

1. An electronic gaming machine, comprising:

a display; and a game controller executing instructions stored in a memory, wherein execution of the instructions cause the game controller to at least:

present a bingo game outcome via the display;

select a set of reel game winning outcomes from a plurality of winning reel game outcomes, wherein the set of reel game winning outcomes provide a collective reel game reward equal to a bingo game reward associated with the bingo game outcome, and wherein each reel game winning outcome of the set of reel game winning outcomes comprises an associated reward specified by a base reward for the respective reel game winning outcome and a multiplier;

spin and stop reels of the display such that the reels present the set of reel game winning outcomes in an order of increasing base rewards; and present, via the display, the multiplier of each presented reel game winning outcome in an emphasized manner when the multiplier for the respective reel game winning outcome is greater than one.

2. The electronic gamine machine of claim 1, wherein execution of the instructions further cause the game controller to select each multiplier from a set of potential multipliers.

3. The electronic gaming machine of claim 2, wherein the set of potential multipliers includes multipliers greater than one when a free play feature mode is triggered.

4. The electronic gaming machine of claim 2, wherein the set of potential multipliers comprises multipliers between 1 and 10, inclusive, when a free play feature mode is triggered.

5. The electronic gaming machine of claim 2, wherein the set of potential multipliers consists of a multiplier of 1 when a free play feature mode is not triggered.

6. The electronic gaming machine of claim 1, wherein execution of the instructions further cause the game controller to trigger a free play feature mode when the bingo game outcome includes a plurality of winning bingo patterns.

7. The electronic gaming machine of claim 1, wherein execution of the instructions further cause the game controller to sort the set of reel game winning outcomes based on the base reward of each reel game winning outcome.

8. The electronic gaming machine of claim 1, wherein execution of the instructions further cause the game controller to:

sort the set of reel game winning outcomes based first on the base reward of each reel game winning outcome, and based second on the multiplier of each reel game winning outcome; and spin the reels and present the set of reel game winning outcomes per the sorted order.

9. A method for operating an electronic gaming machine, comprising:

receiving a bingo game outcome comprising at least one winning bingo pattern;

selecting, via a game controller of the electronic gaming machine, a set of reel game winning outcomes, wherein the set of reel game winning outcomes provide a collective reel game reward equal to a bingo game reward associated with the bingo game outcome, and wherein each reel game winning outcome comprises a base reward and multiplier that specify a reward for the respective reel game winning outcome;

presenting, via a user interface of the electronic gaming machine, the set of reel game winning outcomes by spinning and stopping reels such that the reels present the set of reel game winning outcomes in order of base reward; and presenting, via the user interface, the multiplier of each presented reel game winning outcome in an emphasized manner when the multiplier for the respective reel game winning outcome is greater than one.

10. The method of claim 9, further comprising selecting each multiplier from a set of potential multipliers.

11. The method of claim 10, wherein the set of potential multipliers includes multipliers greater than one when a free play feature mode is triggered.

12. The method of claim 10, wherein the set of potential multipliers comprises multipliers between 1 and 10, inclusive, when a free play feature mode is triggered.

13. The method of claim 10, wherein the set of potential multipliers consists of a multiplier of 1 when a free play feature mode is not triggered.

14. The method of claim 9, further comprising triggering, via the game controller, a free play feature mode when the bingo game outcome includes a plurality of winning bingo patterns.

15. The method of claim 9, further comprising sorting, via the game controller, the set of reel game winning outcomes based on the base reward of each reel gaming winning outcome.

16. The method of claim 9, further comprising:

sorting, via the game controller, the set of reel game winning outcomes based first on the base reward of each reel game winning outcome, and based second on the multiplier of each reel gaming winning outcome; and spinning the reels and presenting the set of reel game winning outcomes per the sorted order.

* * * * *